US009666162B2

(12) United States Patent
Yang et al.

(10) Patent No.: US 9,666,162 B2
(45) Date of Patent: May 30, 2017

(54) METHOD AND APPARATUS FOR CONVERTING IMAGE FROM RGB SIGNALS TO RGBY SIGNALS

(71) Applicant: BOE TECHNOLOGY GROUP CO., LTD., Beijing (CN)

(72) Inventors: Fei Yang, Beijing (CN); Chen Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 477 days.

(21) Appl. No.: 14/361,483

(22) PCT Filed: Sep. 24, 2013

(86) PCT No.: PCT/CN2013/084051
§ 371 (c)(1),
(2) Date: May 29, 2014

(87) PCT Pub. No.: WO2015/014010
PCT Pub. Date: Feb. 5, 2015

(65) Prior Publication Data

US 2015/0035852 A1 Feb. 5, 2015

(30) Foreign Application Priority Data

Jul. 30, 2013 (CN) ..... 2013 1 0325946

(51) Int. Cl.
*G09G 5/02* (2006.01)

(52) U.S. Cl.
CPC ..... *G09G 5/02* (2013.01); *G09G 2300/0452* (2013.01); *G09G 2340/06* (2013.01)

(58) Field of Classification Search
None
See application file for complete search history.

(56) References Cited

U.S. PATENT DOCUMENTS

2005/0083341 A1 4/2005 Higgins et al.
2007/0139669 A1* 6/2007 Lor ..... G09G 5/02 358/1.9

(Continued)

FOREIGN PATENT DOCUMENTS

CN 1689064 A 10/2005
CN 101075426 A 11/2007

(Continued)

OTHER PUBLICATIONS

Chinese Office Action and Search Report regarding Application No. 201310325946.0 dated Oct. 21, 2014. Translation provided by Dragon Intellectual Property Law Firm.

(Continued)

*Primary Examiner* — Aaron M Richer
(74) *Attorney, Agent, or Firm* — Harness, Dickey & Pierce, P.L.C.

(57) ABSTRACT

A method provided by this disclosure may comprise: converting received RGB input signals into corresponding RGB luminance input values respectively; determining RGBY luminance output values according to a position relationship of corresponding point of the RGB luminance input values and regions formed by RGBY in a chromatic diagram respectively; and converting the determined RGBY luminance output values into corresponding RGBY output signals respectively and outputting the corresponding RGBY output signals.

10 Claims, 3 Drawing Sheets

(56) References Cited

U.S. PATENT DOCUMENTS

| | | | | |
|---|---|---|---|---|
| 2012/0206513 | A1* | 8/2012 | Ueno | G09G 3/3413 345/697 |
| 2014/0203244 | A1* | 7/2014 | Hack | H01L 27/3213 257/40 |

FOREIGN PATENT DOCUMENTS

| | | | |
|---|---|---|---|
| CN | 101076848 | A | 11/2007 |
| CN | 101155252 | A | 4/2008 |
| CN | 101163193 | A | 4/2008 |
| CN | 103106672 | A | 5/2013 |
| CN | 103218988 | A | 7/2013 |
| WO | 2011/105378 | A1 | 9/2011 |

OTHER PUBLICATIONS

International Search Report and Written Opinion dated Sep. 24, 2013 regarding PCT/CN2013/084051.

Chinese Office Action dated Mar. 17, 2015 regarding Chinese Application No. 2013103259460 Translation provided by Dragon Intellectual Property Law Firm.

Third Office Action regarding Chinese application No. 201310325946.0, dated Sep. 14, 2015. Translation provided by Dragon Intellectual Property Law Firm.

Written Opinion of the International Searching Authority for international application No. PCT/CN2013/084051.

* cited by examiner

METHOD AND APPARATUS FOR CONVERTING IMAGE FROM RGB SIGNALS TO RGBY SIGNALS

CROSS-REFERENCE TO RELATED APPLICATION

This application is the U.S. national phase of PCT Application No. PCT/CN2013/084051 filed on Sep. 24, 2013, which claims priority to Chinese Patent Application No. 201310325946.0 filed on Jul. 30, 2013, the disclosures of which are incorporated in their entirety by reference herein.

BACKGROUND OF THE INVENTION

Field of the Invention

This disclosure relates to the field of display technologies, and in particular, to a method and apparatus for converting an image from RGB signals to RGBY signals.

Description of the Prior Art

At present, in an image display device employing a liquid crystal display (LCD) and an organic light-emitting diode (OLED), a red (R) subpixel unit, a green (G) subpixel unit, and a blue (B) subpixel unit form a pixel unit, and desired colors are obtained by mixing according to gray-scale values of the subpixel units of each color, thereby display a color image. In the RGB primary colors, the blue subpixel especially has low light-emitting efficiency, which degrades optimization of a display device formed by the RGB primary colors. In addition, the yellow color is more frequently used in a video than other colors. Accordingly, a pixel unit formed by a red (R) subpixel unit, a green (G) subpixel unit, a blue (B) subpixel unit, and a yellow (Y) subpixel unit has been proposed, such that the light-emitting efficiency of the RGB display may be improved, and yellow and golden colors that are hard to be presented in the traditional RGB three primary color technology may be presented truly and vividly. In addition, when the yellow color which supplements for the blue color is enhanced, the expressiveness of the blue color is improved.

Currently, such signal transmission interfaces as the VGA interface and DVI interface all transmit RGB signals. If the RGB signals are directly applied in an RGBY display, image distortion may be present. Accordingly, the RGB signals to be input to the RGBY display need to be converted.

Therefore, without any distortion, how to convert RGB signals into RGBY signals is a technical problem to be solved for a person skilled in the art.

SUMMARY OF THE INVENTION

Embodiments of the present invention provide a method and apparatus for converting an image from RGB signals to RGBY signals, to implement conversion from RGB signals to RGBY signals without distortion.

An embodiment of the present invention provides a method for converting an image from three-color signals to four-color signals. The method may comprise:

converting received three-color input signals into corresponding three-color luminance input values respectively;

determining four-color luminance output values according to a position relationship of a corresponding point of the three-color luminance input values and regions formed by four colors in a chromatic diagram respectively; and converting the determined four-color luminance output values into corresponding four-color output signals respectively and outputting the corresponding four-color output signals.

The embodiments of the present invention achieve the following beneficial effects:

With the method and apparatus for converting an image from RGB signals to RGBY signals according to the embodiments of the present invention, received RGB input signals are converted into corresponding RGB luminance input values respectively; RGBY luminance output values are determined according to a position relationship of a corresponding point of the RGB luminance input values and regions formed by RGBY in a chromatic diagram respectively; and the determined RGBY luminance output values are converted into corresponding RGBY output signals respectively and outputting the corresponding RGBY output signals. The corresponding point of the RGB luminance input values in the chromatic diagram is determined, such that the RGB luminance input values may be converted into the RGBY luminance output values and accordingly colors may not be distorted and the color range of the display apparatus is enlarged in the process of converting the RGB signals into the RGBY signals. In addition, numerical values of the RGBY luminance output values may be adjusted according to practical requirements in the process of determining of the RGBY luminance output values according to the corresponding point of the RGB luminance input values in the chromatic diagram, such that the luminance of a display device as a whole may be improved and accordingly the image contrast may be improved.

DETAILED DESCRIPTION OF THE PREFERRED EMBODIMENTS

A method and apparatus for converting an image from RGB signals to RGBY signals according to the embodiments of the present invention are described as follows in detail with reference to attached drawings. In embodiments of the present invention, the three-color input signals include, for example, red (R) signal, green (G) signal and blue (B) signal, whereas the four-color output signals include, for example, red (R) signal, green (G) signal, blue (B) signal and yellow (Y) signal. However, the present invention is not limited to the above.

Figure 1:
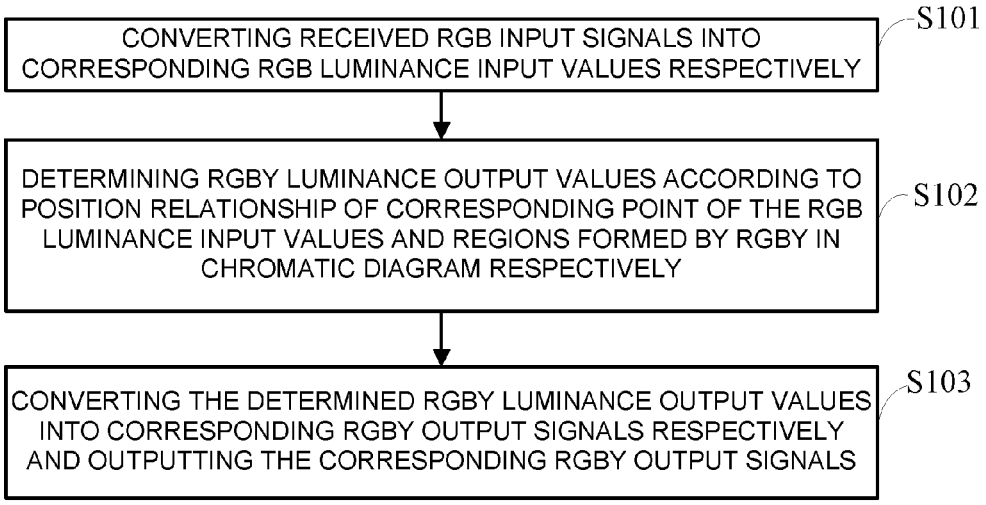
FIG. 1 is a first flowchart of a method for converting an image from RGB signals to RGBY signals according to an embodiment of the present invention.

An embodiment of the present invention provides a method for converting an image from RGB signals to RGBY signals. As illustrated in FIG. 1, the method may specifically comprise the following steps:

S101: converting received RGB input signals into corresponding RGB luminance input values respectively;

S102: determining RGBY luminance output values according to a position relationship of a corresponding point of the RGB luminance input values and regions formed by RGBY in a chromatic diagram respectively; and S103: converting the determined RGBY luminance output values into corresponding RGBY output signals respectively and outputting the corresponding RGBY output signals.

Steps in the method for converting an image according to the embodiment of the present invention are further described.

Figure 2:
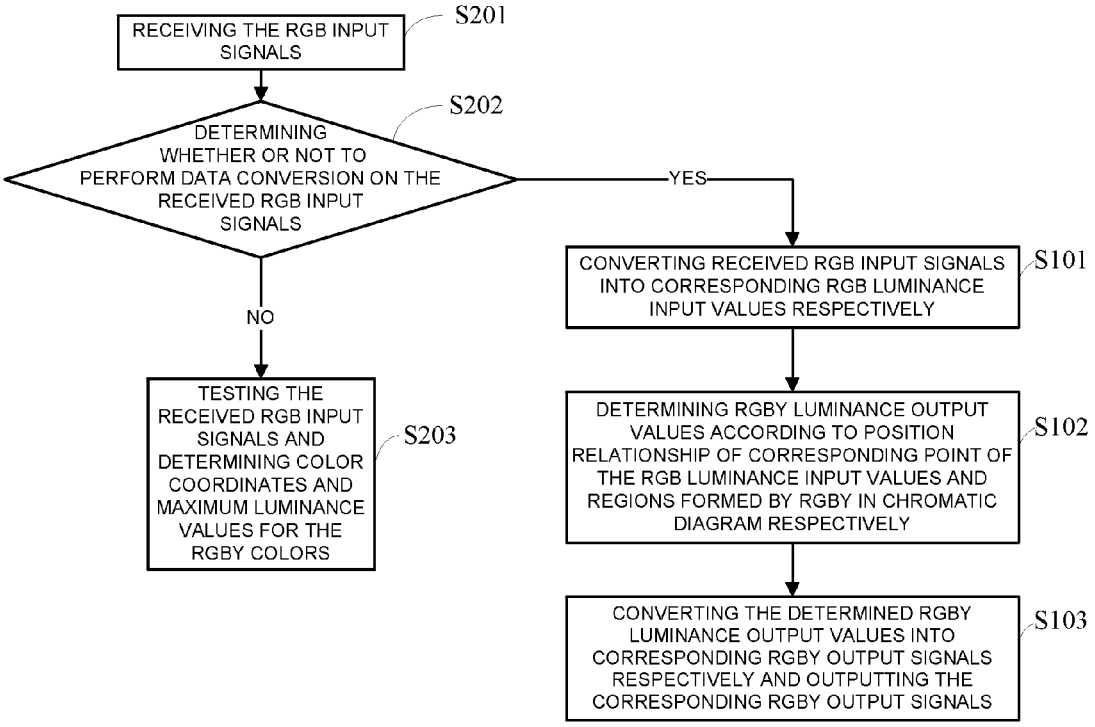
FIG. 2 is a second flowchart of the method for converting an image from RGB signals to RGBY signals according to an embodiment of the present invention.

Specifically, in the method according to the embodiment of the present invention, before step S101 is performed, when RGB input signals are received, as illustrated in FIG. 2, the following steps may also be performed.

S201: receiving the RGB input signals.

In this embodiment, an 8-bit input signal is used as an example to describe three color input signals in the RGB input signals. To be specific, data signals corresponding to three colors R, G, and B may be respectively denoted by gray-scale values ranging between 0 and 255.

S202: determining, according to an externally input enable signal En, whether or not to perform data conversion on the received RGB input signals, i.e., whether or not to perform steps S101 to S103. For example, when the externally input enable signal En=1, data conversion is performed on the received RGB input signals, i.e., steps S101 to S103 are performed; and when the externally input enable signal En=0, step S203 is performed.

S203: testing the received RGN input signal and determining color coordinates and maximum luminance values for the RGBY colors.

Specifically, the RGB input signals may be tested by using a test control signal Test. For example, when Test=1, signal output values $R_0$, $B_0$, and $G_0$ respectively correspond to signal input values Ri, Bi, and Gi, signal output value $Y_0=0$; color coordinates $R(x_R, y_R)$, $G(x_G, y_G)$, $B(x_B, y_B)$ of colors of red (R), green (G), and blue (B) and the corresponding maximum luminance values $L_{Rmax}$, $L_{Gmax}$, and $L_{Bmax}$ may be obtained by using the signal output values. When Test=0, signal output values $R_0=0$, $B_0=0$, $G_0=0$, $Y_0=1$; color coordinates $(Y(x_Y,y_Y))$ of the yellow color and the corresponding maximum luminance value ($L_{Ymax}$) may be obtained by using the signal output values.

Preferably, in step S101 in the method for converting an image according to the embodiment of the present invention, the converting the received RGB input signal into corresponding RGB luminance input values respectively may be specifically implemented in the Gamma conversion manner. To be specific, the RGB input signals may be converted into the corresponding RGB luminance input values respectively by using the following formulas:

$$L_R = L_{Rmax} \times \left(\frac{Ri}{255}\right)^{\gamma};$$

$$L_G = L_{Gmax} \times \left(\frac{Gi}{255}\right)^{\gamma};$$

$$L_B = L_{Bmax} \times \left(\frac{Bi}{255}\right)^{\gamma};$$

where $L_R$ denotes the red luminance input value in the RGB luminance input values, $L_G$ denotes the green luminance input value in the RGB luminance input values, $L_B$ denotes the blue luminance input value in the RGB luminance input values, Ri denotes the value of the red input signal in the RGB input signals, Gi denotes the value of the green input signal in the RGB input signals, Bi denotes the value of the blue input signal in the RGB input signals, $L_{Rmax}$ denotes the maximum red luminance value, $L_{Gmax}$ denotes the maximum green luminance value, $L_{Bmax}$ denotes the maximum blue luminance value, and $\gamma$ denotes the Gamma conversion factor.

In a specific calculation, the gamma factor $\gamma$ is typically set to 2.2.

Figure 3:
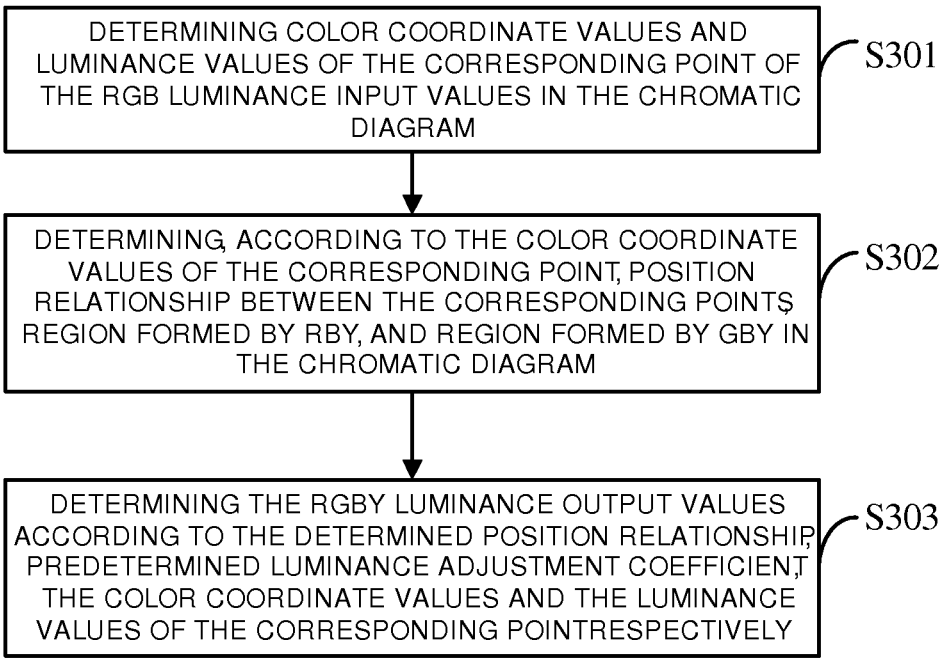
FIG. 3 is a third flowchart of the method for converting an image from RGB signals to RGBY signals according to an embodiment of the present invention.

Specifically, in step S102 in the method for converting an image according to the embodiment of the present invention, the determining RGBY luminance output values according to a position relationship of a corresponding point of the RGB luminance input values and regions formed by RGBY in a chromatic diagram respectively, as illustrated in FIG. 3, may be implemented by the following steps:

S301: determining color coordinate values and luminance values of the corresponding point of the RGB luminance input values in the chromatic diagram.

Specifically, the color coordinate values and the luminance values of the corresponding point of the RGB luminance input values may be calculated by using the following formulas:

$$L_A = L_R + L_G + L_B$$

$$x = \frac{x_R \times \frac{L_R}{y_R} + x_G \times \frac{L_G}{y_G} + x_B \times \frac{L_B}{y_B}}{\frac{L_R}{y_R} + \frac{L_G}{y_G} + \frac{L_B}{y_B}}$$

$$y = \frac{L_R + L_G + L_B}{\frac{L_R}{y_R} + \frac{L_G}{y_G} + \frac{L_B}{y_B}}$$

where $L_A$ denotes the luminance values of the corresponding point, $L_G$ denotes the green luminance input value in the RGB luminance input values, $L_B$ denotes the blue luminance input value in the RGB luminance input values, $L_R$ denotes the red luminance input value in the RGB luminance input values, (x, y) denotes the color coordinate values of the corresponding point in the chromatic diagram, $(x_R, y_R)$ denotes the color coordinate values of the red color in the chromatic diagram, $(x_G, y_G)$ denotes the color coordinate values of the green color in the chromatic diagram, and $(x_B, y_B)$ denotes the color coordinate values of the blue color in the chromatic diagram.

S302: determining, according to the color coordinate values of the corresponding point, a position relationship between the corresponding point, a region formed by RBY, and a region formed by GBY in the chromatic diagram.

S303: determining the RGBY luminance output values according to the determined position relationship, a predetermined luminance adjustment coefficient, the color coordinate values and the luminance values of the corresponding point respectively. The luminance adjustment coefficient may be predetermined according to practical requirements. In a specific implementation, the luminance adjustment coefficient may be changed to improve the RGBY luminance output values. In a specific implementation, the value range of the luminance adjustment coefficient is generally set between 0.5 and 2, which are not limited thereto.

Figure 4:
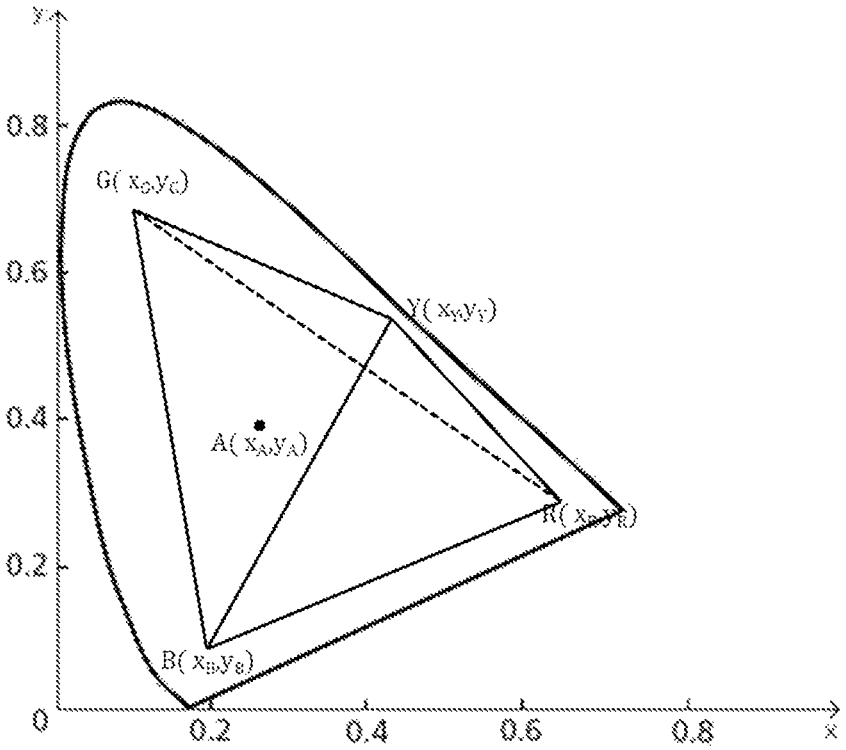
FIG. 4 is a schematic structural view of a corresponding point A in a chromatic diagram according to an embodiment of the present invention.
Figure 5:
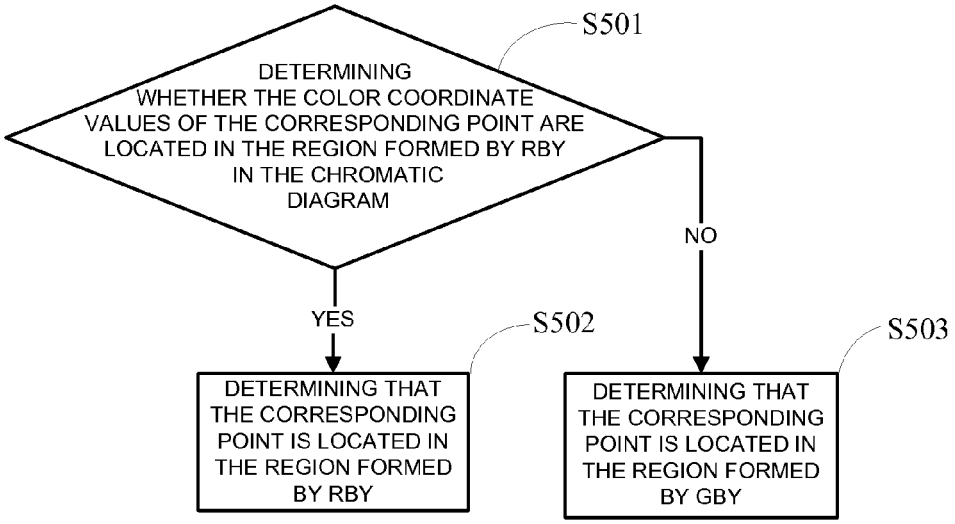
FIG. 5 is a fourth flowchart of the method for converting an image from RGB signals to RGBY signals according to an embodiment of the present invention.

In step S302, in the chromatic diagram as illustrated in FIG. 4, the determining a position relationship between the corresponding point A, a region formed by RBY, and a region formed by GBY in the chromatic diagram refers to determining, in the chromatic diagram, whether the color coordinates of the corresponding point are located in the region formed by RBY or the region formed by GBY. In a specific implementation, as illustrated in FIG. 5, the determination may be implemented by the following steps:

S501: determining whether the color coordinate values of the corresponding point in the chromatic diagram are located in the region formed by RBY; if yes, performing step S502; and otherwise, performing step S503.

S502: determining that the corresponding point is located in the region formed by RBY.

S503: determining that the corresponding point is located in the region formed by GBY.

Specifically, it may be determined as whether the color coordinate values of the corresponding point in step S501 are located in a triangle region formed by RBY in the following manners.

(1) Area method: Assume that the corresponding point is A, areas $S_{ARB}$, $S_{ARY}$, $S_{ABY}$, and $S_{RBY}$ of triangles formed by ARB, ARY, ABY, and RBY are calculated respectively; when $S_{ARB}+S_{ABY}+S_{ARY}=S_{RBY}$, it may be determined that the corresponding point A is located in a region formed by RBY; and when $S_{ARB}+S_{ABY}+S_{ARY}\neq S_{RBY}$, it may be determined that the corresponding point A is located out of the region formed by RBY.

(2) Angle sum method: Assume that the corresponding point is A, angles ∠RAY, ∠RAB, and ∠BAY are calculated respectively; when ∠RAY+∠RAB+∠BAY=360°, it may be determined that the corresponding point A is located in a region formed by RBY; and when ∠RAY+∠RAB+∠BAY≠360°, it may be determined that the corresponding point A is located out of the region formed by RBY.

(3) Uni-direction method: Assume that the corresponding point is A, it is calculated which side of line RB, line BY, and line YR the point A is located on; along the direction of BYRB, when the point A is located on the same side of the line RB, line BY, and line YR, it may be determined that the corresponding point A is located in a region formed by RBY; and when the point A is located on different sides of the line RB, line BY, and line YR, it may be determined that the corresponding point A is located out of the region formed by RBY.

The above three methods for determining whether the color coordinate values of the corresponding point in step S501 are located in the triangle region formed by RBY is only illustrative. In a specific implementation, a position relationship between the corresponding point and the triangle region may be determined in other manners, which is not described herein any further.

In step S302, after the region where the color coordinates of the corresponding point are located is determined, step S303 is performed, which specifically comprises the following scenarios: when it is determined that the corresponding point is located in the region formed by RBY, the green luminance output value in the RGBY luminance output values is set to zero; and when it is determined that the corresponding point is located in the region formed by GBY, the red luminance output value in the RGBY luminance output values is set to zero. To be specific, a luminance output value in the RGBY luminance output values is zero. In this way, it may be ensured that power consumption of the display is effectively reduced without image distortion, thereby effectively prolongs service life of the display. In addition, only three valid luminance output values are available in the RGBY luminance output values, which, compared with four valid luminance output values, may also effectively reduce power supply of the display, thereby reducing usage cost.

Specifically, in step S303, the determining the RGBY luminance output values according to the determined position relationship, a predetermined luminance adjustment coefficient, the color coordinate values and the luminance values of the corresponding point respectively may specifically comprise the following two scenarios:

(1) When it is determined that the corresponding point is located in the region formed by RBY, the RGBY luminance output values are calculated by using the following formulas:

$$L_{R'} = \frac{\left(\frac{x}{y}-\frac{x_Y}{y_Y}\right)-\frac{\left(\frac{x_B}{y_B}-\frac{x_Y}{y_Y}\right)\times\left(1-\frac{y}{y_Y}\right)}{\frac{y}{y_B}-\frac{y}{y_Y}}}{\frac{x_R}{y_R}-\frac{x_Y}{y_Y}-\frac{\left(\frac{1}{y_R}-\frac{1}{y_Y}\right)\times\left(\frac{x_B}{y_B}-\frac{x_Y}{y_Y}\right)}{\frac{1}{y_B}-\frac{1}{y_Y}}}\times K\times L_A$$

$$L_{B'} = \frac{\left(1-\frac{y}{y_Y}\right)-\left(\frac{y}{y_R}-\frac{y}{y_Y}\right)\times\frac{\left(\frac{x}{y}-\frac{x_Y}{y_Y}\right)-\frac{\left(\frac{x_B}{y_B}-\frac{x_Y}{y_Y}\right)\times\left(1-\frac{y}{y_Y}\right)}{\frac{y}{y_B}-\frac{y}{y_Y}}}{\frac{x_R}{y_R}-\frac{x_Y}{y_Y}-\frac{\left(\frac{1}{y_R}-\frac{1}{y_Y}\right)\times\left(\frac{x_B}{y_B}-\frac{x_Y}{y_Y}\right)}{\frac{1}{y_B}-\frac{1}{y_Y}}}}{\frac{y}{y_B}-\frac{y}{y_Y}}\times K\times L_A$$

$$L_{Y'} = K\times(L_A - L_{R'} - L_{B'})$$

$$L_{G'} = 0;$$

where $L_{G'}$ denotes the green luminance output value in the RGBY luminance output values, $L_{B'}$ denotes the blue luminance output value in the RGBY luminance output values, $L_{R'}$ denotes the red luminance output value in the RGBY luminance output values, $L_{Y'}$ denotes the yellow luminance output value in the RGBY luminance output values, $L_A$ denotes the luminance values of the corresponding point, K denotes the luminance adjustment coefficient, (x, y) denotes the color coordinate values of the corresponding point in the chromatic diagram, $(x_R, y_R)$ denotes the color coordinate values of the red color in the chromatic diagram, $(x_B, y_B)$ denotes the color coordinate values of the blue color in the chromatic diagram, and $(x_Y, y_Y)$ denotes the color coordinate values of the yellow color in the chromatic diagram.

(2) When it is determined that the corresponding point is located in the region formed by GBY, the RGBY luminance output values are calculated by using the following formulas:

$$L_{G'} = \frac{\left(\frac{x}{y}-\frac{x_Y}{y_Y}\right)-\frac{\left(\frac{x_B}{y_B}-\frac{x_Y}{y_Y}\right)\times\left(1-\frac{y}{y_Y}\right)}{\frac{y}{y_B}-\frac{y}{y_Y}}}{\frac{x_G}{y_G}-\frac{x_Y}{y_Y}-\frac{\left(\frac{1}{y_G}-\frac{1}{y_Y}\right)\times\left(\frac{x_B}{y_B}-\frac{x_Y}{y_Y}\right)}{\frac{1}{y_B}-\frac{1}{y_Y}}}\times K\times L_A$$

-continued $$L_{B'} = \frac{\left(1-\frac{y}{y_Y}\right)-\left(\frac{y}{y_G}-\frac{y}{y_Y}\right)\times\frac{\left(\frac{x}{y}-\frac{x_Y}{y_Y}\right)-\frac{\left(\frac{x_B}{y_B}-\frac{x_Y}{y_Y}\right)\times\left(1-\frac{y}{y_Y}\right)}{\frac{y}{y_B}-\frac{y}{y_Y}}}{\frac{x_G}{y_G}-\frac{x_Y}{y_Y}-\frac{\left(\frac{1}{y_G}-\frac{1}{y_Y}\right)\times\left(\frac{x_B}{y_B}-\frac{x_Y}{y_Y}\right)}{\frac{1}{y_B}-\frac{1}{y_Y}}}}{\frac{y}{y_B}-\frac{y}{y_Y}}\times K\times L_A$$

$$L_{Y'} = K\times(L_A - L_{G'} - L_{B'})$$

$$L_{R'} = 0;$$

where $L_{G'}$ denotes the green luminance output value in the RGBY luminance output values, $L_{B'}$ denotes the blue luminance output value in the RGBY luminance output values, $L_{R'}$ denotes the red luminance output value in the RGBY luminance output values, $L_{Y'}$ denotes the yellow luminance output value in the RGBY luminance output values, $L_A$ denotes the luminance values of the corresponding point, K denotes the luminance adjustment coefficient, (x, y) denotes the color coordinate values of the corresponding point in the chromatic diagram, $(x_G, y_G)$ denotes the color coordinate values of the green color in the chromatic diagram, $(x_B, y_B)$ denotes the color coordinate values of the blue color in the chromatic diagram, and $(x_Y, y_Y)$ denotes the color coordinate values of the yellow color in the chromatic diagram.

In a specific implementation, the RGBY luminance output values in the above two scenarios may be respectively calculated by using the above formulas, or by using other formulas, which is not limited herein.

Specifically, in step S103 in the method for converting an image according to the embodiment of the present invention, the converting the determined RGBY luminance output values into corresponding RGBY output signals and outputting the corresponding RGBY output signals may be specifically implemented in a reverse Gamma conversion manner. To be specific, the RGBY luminance output values are respectively converted into the corresponding RGBY output signals by using the following formulas:

$$R_0 = \left(\frac{L_{R'}}{L_{Rmax}}\right)^{\frac{1}{\gamma}}\times 255;$$

$$G_0 = \left(\frac{L_{G'}}{L_{Gmax}}\right)^{\frac{1}{\gamma}}\times 255;$$

$$B_0 = \left(\frac{L_{B'}}{L_{Bmax}}\right)^{\frac{1}{\gamma}}\times 255;$$

$$Y_0 = \left(\frac{L_{Y'}}{L_{Ymax}}\right)^{\frac{1}{\gamma}}\times 255;$$

where $L_{R'}$ denotes the red luminance output value in the RGBY luminance output values, $L_{G'}$ denotes the green luminance output value in the RGBY luminance output values, $L_{B'}$ denotes the blue luminance output value in the RGBY luminance output values, $L_{Y'}$ denotes the yellow luminance output value in the RGBY luminance output values, $R_0$ denotes the value of the red output signal in the RGBY output signals, $G_0$ denotes the value of the green output signal in the RGBY output signals, $B_0$ denotes the value of the blue output signal in the RGBY output signals, $Y_0$ denotes the value of the yellow output signal in the RGBY output signals, $L_{Rmax}$ denotes the maximum red luminance value, $L_{Gmax}$ denotes the maximum green luminance value, $L_{Bmax}$ denotes the maximum blue luminance value, $L_{Ymax}$ denotes the maximum yellow luminance value, and γ denotes the gamma conversion factor.

In specific calculations, the gamma factor γ is typically set to 2.2.

Based on the same inventive concept, another embodiment of the present invention provides an apparatus for converting an image from RGB signals to RGBY signals. Since the apparatus solves the problem under the principles that are analogous to those of the method for converting an image from RGB signals to RGBY signals, implementation of the apparatus may be referred to that of the method, and repeated description is not given herein any further.

Figure 6:
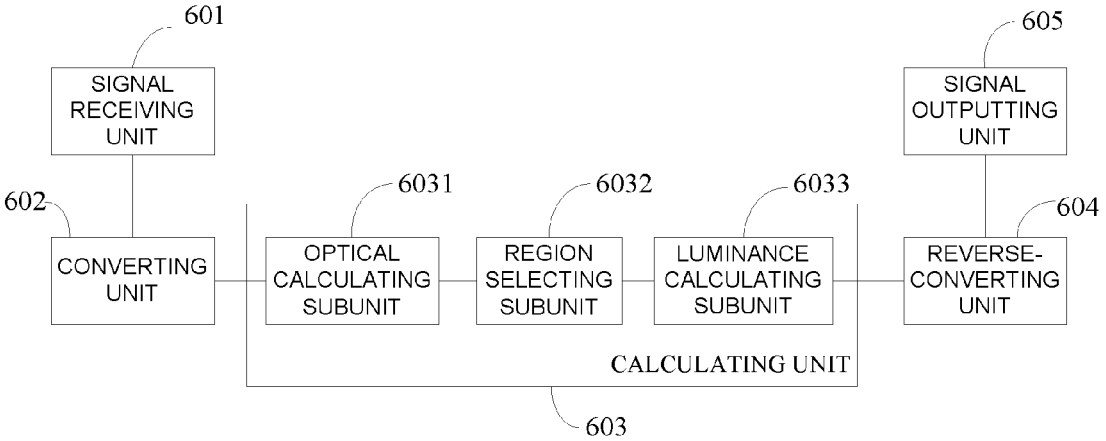
FIG. 6 is a schematic structural view of an apparatus for converting an image from RGB signals to RGBY signals according to an embodiment of the present invention.

Another embodiment of the present invention provides an apparatus for converting an image from RGB signals to RGBY signals. As illustrated in FIG. 6, the apparatus may comprise:

a signal receiving unit 601, configured to receive RGB input signals;

a converting unit 602, configured to convert the received RGB input signals into corresponding RGB luminance input values respectively;

a calculating unit 603, configured to determine RGBY luminance output values according to a position relationship of a corresponding point of the RGB luminance input values and regions formed by RGBY in a chromatic diagram respectively;

a reverse-converting unit 604, configured to convert the determined RGBY luminance output values into corresponding RGBY output signals respectively; and a signal outputting unit 605, configured to output the corresponding RGBY output signals.

Further, the calculating unit 603 in the apparatus for converting an image from RGB signals to RGBY signals according to the embodiment of the present invention, as illustrated in FIG. 6, specifically comprises:

an optical calculating subunit 6031, configured to determine color coordinate values and luminance values of the corresponding point of the RGB luminance input values in the chromatic diagram;

a region selecting subunit 6032, configured to determine, according to the color coordinate values of the corresponding point, a position relationship between the corresponding point, a region formed by RBY, and a region formed by GBY in the chromatic diagram; and a luminance calculating subunit 6033, configured to respectively determine the RGBY luminance output values according to the determined position relationship, a predetermined luminance adjustment coefficient, the color coordinate values and the luminance values of the corresponding point.

Further, the region selecting subunit 6032 is specifically configured to: determine whether the color coordinate values of the corresponding point are located in the region formed by RBY in the chromatic diagram; if yes, determine that the corresponding point is located in the region formed by RBY; and otherwise, determine that the corresponding point is located in the region formed by GBY.

Further, the luminance calculating subunit 6033 is specifically configured to: when it is determined that the corresponding point is located in the region formed by RBY, set the green luminance output value in the RGBY luminance output values to zero; and when it is determined that the corresponding point is located in the region formed by GBY, set the red luminance output value in the RGBY luminance output values to zero.

Further, the luminance calculating subunit 6033 is specifically configured to: when it is determined that the corresponding point is located in the region formed by RBY, calculate the RGBY luminance output values by using the following formulas:

$$L_{R'} = \frac{\left(\frac{x}{y} - \frac{x_Y}{y_Y}\right) - \frac{\left(\frac{x_B}{y_B} - \frac{x_Y}{y_Y}\right)\times\left(1 - \frac{y}{y_Y}\right)}{\frac{y}{y_B} - \frac{y}{y_Y}}}{\frac{x_R}{y_R} - \frac{x_Y}{y_Y} - \frac{\left(\frac{1}{y_R} - \frac{1}{y_Y}\right)\times\left(\frac{x_B}{y_B} - \frac{x_Y}{y_Y}\right)}{\frac{1}{y_B} - \frac{1}{y_Y}}} \times K \times L_A$$

$$L_{B'} = \frac{\left(1 - \frac{y}{y_Y}\right) - \left(\frac{y}{y_R} - \frac{y}{y_Y}\right)\times\frac{\left(\frac{x}{y} - \frac{x_Y}{y_Y}\right) - \frac{\left(\frac{x_B}{y_B} - \frac{x_Y}{y_Y}\right)\times\left(1 - \frac{y}{y_Y}\right)}{\frac{y}{y_B} - \frac{y}{y_Y}}}{\frac{x_R}{y_R} - \frac{x_Y}{y_Y} - \frac{\left(\frac{1}{y_R} - \frac{1}{y_Y}\right)\times\left(\frac{x_B}{y_B} - \frac{x_Y}{y_Y}\right)}{\frac{1}{y_R} - \frac{1}{y_Y}}}}{\frac{y}{y_B} - \frac{y}{y_Y}} \times K \times L_A$$

$$L_{Y'} = K \times (L_A - L_{R'} - L_{B'})$$
$$L_{G'} = 0;$$

where $L_{G'}$ denotes the green luminance output value in the RGBY luminance output values, $L_{B'}$ denotes the blue luminance output value in the RGBY luminance output values, $L_{R'}$ denotes the red luminance output value in the RGBY luminance output values, $L_{Y'}$ denotes the yellow luminance output value in the RGBY luminance output values, $L_A$ denotes the luminance values of the corresponding point, K denotes the luminance adjustment coefficient, (x, y) denotes the color coordinate values of the corresponding point in the chromatic diagram, $(x_R, y_R)$ denotes the color coordinate values of the red color in the chromatic diagram, $(x_B, y_B)$ denotes the color coordinate values of the blue color in the chromatic diagram, and $(x_Y, y_Y)$ denotes the color coordinate values of the yellow color in the chromatic diagram.

Further, the luminance calculating subunit 6033 is specifically configured to: when it is determined that the corresponding point is located in the region formed by GBY, calculate the RGBY luminance output values by using the following formulas:

$$L_{G'} = \frac{\left(\frac{x}{y} - \frac{x_Y}{y_Y}\right) - \frac{\left(\frac{x_B}{y_B} - \frac{x_Y}{y_Y}\right)\times\left(1 - \frac{y}{y_Y}\right)}{\frac{y}{y_B} - \frac{y}{y_Y}}}{\frac{x_G}{y_G} - \frac{x_Y}{y_Y} - \frac{\left(\frac{1}{y_G} - \frac{1}{y_Y}\right)\times\left(\frac{x_B}{y_B} - \frac{x_Y}{y_Y}\right)}{\frac{1}{y_B} - \frac{1}{y_Y}}} \times K \times L_A$$

-continued $$L_{B'} = \frac{\left(1 - \frac{y}{y_Y}\right) - \left(\frac{y}{y_G} - \frac{y}{y_Y}\right)\times\frac{\left(\frac{x}{y} - \frac{x_Y}{y_Y}\right) - \frac{\left(\frac{x_B}{y_B} - \frac{x_Y}{y_Y}\right)\times\left(1 - \frac{y}{y_Y}\right)}{\frac{y}{y_B} - \frac{y}{y_Y}}}{\frac{x_G}{y_G} - \frac{x_Y}{y_Y} - \frac{\left(\frac{1}{y_G} - \frac{1}{y_Y}\right)\times\left(\frac{x_B}{y_B} - \frac{x_Y}{y_Y}\right)}{\frac{1}{y_B} - \frac{1}{y_Y}}}}{\frac{y}{y_B} - \frac{y}{y_Y}} \times K \times L_A$$

$$L_{Y'} = K \times (L_A - L_{G'} - L_{B'})$$
$$L_{R'} = 0;$$

where $L_{G'}$ denotes the green luminance output value in the RGBY luminance output values, $L_{B'}$ denotes the blue luminance output value in the RGBY luminance output values, $L_{R'}$ denotes the red luminance output value in the RGBY luminance output values, $L_{Y'}$ denotes the yellow luminance output value in the RGBY luminance output values, $L_A$ denotes the luminance values of the corresponding point, K denotes the luminance adjustment coefficient, (x, y) denotes the color coordinate values of the corresponding point in the chromatic diagram, $(x_G, y_G)$ denotes the color coordinate values of the green color in the chromatic diagram, $(x_B, y_B)$ denotes the color coordinate values of the blue color in the chromatic diagram, and $(x_Y, y_Y)$ denotes the color coordinate values of the yellow color in the chromatic diagram.

Further, the optical calculating subunit 6031 is specifically configured to calculate the color coordinate values and the luminance values of the corresponding point of the RGB luminance input values in the chromatic diagram by using the following formulas:

$$L_A = L_R + L_G + L_B$$

$$x = \frac{x_R \times \frac{L_R}{y_R} + x_G \times \frac{L_G}{y_G} + x_B \times \frac{L_B}{y_B}}{\frac{L_R}{y_R} + \frac{L_G}{y_G} + \frac{L_B}{y_B}}$$

$$y = \frac{L_R + L_G + L_B}{\frac{L_R}{y_R} + \frac{L_G}{y_G} + \frac{L_B}{y_B}};$$

where $L_A$ denotes the luminance values of the corresponding point, $L_G$ denotes the green luminance input value in the RGB luminance input values, $L_B$ denotes the blue luminance input value in the RGB luminance input values, $L_R$ denotes the red luminance input value in the RGB luminance input values, (x, y) denotes the color coordinate values of the corresponding point in the chromatic diagram, $(x_R, y_R)$ denotes the color coordinate values of the red color in the chromatic diagram, $(x_G, y_G)$ denotes the color coordinate values of the green color in the chromatic diagram, and $(x_B, y_B)$ denotes the color coordinate values of the blue color in the chromatic diagram.

Further, the converting unit 602 in the apparatus for converting an image from RGB signals to RGBY signal according to the embodiment of the present invention is specifically configured to respectively convert the received RGB input signals into the corresponding RGB luminance input values by using the following formulas:

$$L_R = L_{Rmax} \times \left(\frac{Ri}{255}\right)^{\gamma};$$

$$L_G = L_{Gmax} \times \left(\frac{Gi}{255}\right)^{\gamma};$$

$$L_B = L_{Bmax} \times \left(\frac{Bi}{255}\right)^{\gamma};$$

where $L_R$ denotes the red luminance input value in the RGB luminance input values, $L_G$ denotes the green luminance input value in the RGB luminance input values, $L_B$ denotes the blue luminance input value in the RGB luminance input values, Ri denotes the value of the red input signal in the RGB input signals, Gi denotes the value of the green input signal in the RGB input signals, Bi denotes the value of the blue input signal in the RGB input signals, $L_{Rmax}$ denotes the maximum red luminance value, $L_{Gmax}$ denotes the maximum green luminance value, $L_{Bmax}$ denotes the maximum blue luminance value, and γdenotes the Gamma conversion factor.

Further, the reverse-converting unit 604 in the apparatus for converting an image from RGB signals to RGBY signal according to the embodiment of the present invention is specifically configured to respectively convert the determined RGBY luminance output values into the corresponding RGBY output signals by using the following formulas:

$$R_0 = \left(\frac{L_{R'}}{L_{Rmax}}\right)^{\frac{1}{\gamma}} \times 255;$$

$$G_0 = \left(\frac{L_{G'}}{L_{Gmax}}\right)^{\frac{1}{\gamma}} \times 255;$$

$$B_0 = \left(\frac{L_{B'}}{L_{Bmax}}\right)^{\frac{1}{\gamma}} \times 255;$$

$$Y_0 = \left(\frac{L_{Y'}}{L_{Ymax}}\right)^{\frac{1}{\gamma}} \times 255;$$

where $L_{R'}$ denotes the red luminance output value in the RGBY luminance output values, $L_{G'}$ denotes the green luminance output value in the RGBY luminance output values, $L_{B'}$ denotes the blue luminance output value in the RGBY luminance output values, $L_{Y'}$ denotes the yellow luminance output value in the RGBY luminance output values, $R_0$ denotes the value of the red output signal in the RGBY output signals, $G_0$ denotes the value of the green output signal in the RGBY output signals, $B_0$ denotes the value of the blue output signal in the RGBY output signals, $Y_0$ denotes the value of the yellow output signal in the RGBY output signals, $L_{Rmax}$ denotes the maximum red luminance value, $L_{Gmax}$ denotes the maximum green luminance value, $L_{Bmax}$ denotes the maximum blue luminance value, $L_{Ymax}$ denotes the maximum yellow luminance value, and γ denotes the gamma conversion factor.

According to the above embodiments of the present invention, a person skilled in the art may clearly understand that the embodiments of the present invention may be implemented by means of hardware or by means of software plus necessary general hardware platform. Based on such understandings, the technical solutions according to the embodiments of the present invention may be essentially embodied in the form of a software product. The software product may be stored in a non-volatile storage medium such as a read only memory (ROM), a U disk, a mobile hard disk and the like. The software product comprises a number of instructions that enable a computer device (a PC, a server, or a network device) to perform the method provided in the embodiments of the present invention.

A person skilled in the art may understand that the accompanying drawings are exemplary ones for illustrating the embodiments, and the involved modules and procedures are not definitely required for the implementation of the present invention.

A person skilled in the art may understand that the modules in the devices provided in embodiments may be arranged in the devices according to the description of the embodiments, or may be in one or a plurality of devices which are different from those described in the embodiments of the present invention. The modules according to the above embodiments may be combined in one module, or split into a plurality of submodules.

The sequence numbers of the embodiments of the present invention are only for ease of description, but do not denote the preference of the embodiments.

With the method and apparatus for converting an image from RGB signals to RGBY signals according to the embodiments of the present invention, received RGB input signals are respectively converted into corresponding RGB luminance input values; RGBY luminance output values are respectively determined according to a position relationship of a corresponding point of the RGB luminance input values and regions formed by RGBY in a chromatic diagram; and the determined RGBY luminance output values are respectively converted into corresponding RGBY output signals and outputting the corresponding RGBY output signals. The corresponding point of the RGB luminance input values in the chromatic diagram is determined, such that the RGB luminance input values may be converted into the RGBY luminance output values and accordingly colors may not be distorted and the color range of the display apparatus is enlarged in the process of converting the RGB signals into the RGBY signals. In addition, numerical values of the RGBY luminance output values may be adjusted according to practical requirements in the process of determining of the RGBY luminance output values according to the corresponding point of the RGB luminance input values in the chromatic diagram, such that the luminance of a display device as a whole may be improved and accordingly the image contrast may be improved.

Apparently, a person skilled in the art may make various modifications and variations to the present invention without departing from the spirit and principles of the present invention. If such modifications and variations fall within the scope defined by the claims of the present invention and equivalent technologies thereof, the present invention is intended to cover such modifications and variations.

What is claimed is:

1. A method for converting an image from RGB input signals to RGBY output signals, comprising:

converting received RGB input signals into corresponding RGB luminance input values respectively;

determining color coordinate values and luminance values of a corresponding point of the corresponding RGB luminance input values in a chromatic diagram;

determining, according to the color coordinate values of the corresponding point, a position relationship between the corresponding point and a region formed by RBY as well as a position relationship between the corresponding point and a region formed by GBY in the chromatic diagram;

determining RGBY luminance output values according to the determined position relationships, a predetermined luminance adjustment coefficient, the color coordinate values and the luminance values of the corresponding point respectively; and converting the determined RGBY luminance output values into corresponding RGBY output signals respectively and outputting the corresponding RGBY output signals, wherein the determining the RGBY luminance output values according to the determined position relationships, a predetermined luminance adjustment coefficient, the color coordinate values and the luminance values of the corresponding point respectively comprises:

when it is determined that the corresponding point is located in the region formed by RBY, calculating the RGBY luminance output values by using the following formulas:

$$L_{R'} = \frac{\left(\frac{x}{y} - \frac{x_Y}{y_Y}\right) - \frac{\left(\frac{x_B}{y_B} - \frac{x_Y}{y_Y}\right)\times\left(1 - \frac{y}{y_Y}\right)}{\frac{y}{y_B} - \frac{y}{y_Y}}}{\frac{x_R}{y_R} - \frac{x_Y}{y_Y} - \frac{\left(\frac{1}{y_R} - \frac{1}{y_Y}\right)\times\left(\frac{x_B}{y_B} - \frac{x_Y}{y_Y}\right)}{\frac{1}{y_B} - \frac{1}{y_Y}}} \times K \times L_A$$

$$L_{B'} = \frac{\left(1 - \frac{x_Y}{y_Y}\right) - \left(\frac{y}{y_R} - \frac{y}{y_Y}\right)\times\frac{\left(\frac{x}{y} - \frac{x_Y}{y_Y}\right) - \frac{\left(\frac{x_B}{y_B} - \frac{x_Y}{y_Y}\right)\times\left(1 - \frac{y}{y_Y}\right)}{\frac{y}{y_B} - \frac{y}{y_Y}}}{\frac{x_R}{y_R} - \frac{x_Y}{y_Y} - \frac{\left(\frac{1}{y_R} - \frac{1}{y_Y}\right)\times\left(\frac{x_B}{y_B} - \frac{x_Y}{y_Y}\right)}{\frac{1}{y_B} - \frac{1}{y_Y}}}}{\frac{y}{y_B} - \frac{y}{y_Y}} \times K \times L_A$$

$$L_{Y'} = K \times (L_A - L_{R'} - L_{B'})$$

$$L_{G'} = 0,$$

or when it is determined that the corresponding point is located in the region formed by GBY, calculate the RGBY luminance output values by using the following formulas:

$$L_{G'} = \frac{\left(\frac{x}{y} - \frac{x_Y}{y_Y}\right) - \frac{\left(\frac{x_B}{y_B} - \frac{x_Y}{y_Y}\right)\times\left(1 - \frac{y}{y_Y}\right)}{\frac{y}{y_B} - \frac{y}{y_Y}}}{\frac{x_G}{y_G} - \frac{x_Y}{y_Y} - \frac{\left(\frac{1}{y_G} - \frac{1}{y_Y}\right)\times\left(\frac{x_B}{y_B} - \frac{x_Y}{y_Y}\right)}{\frac{1}{y_B} - \frac{1}{y_Y}}} \times K \times L_A$$

-continued $$L_{B'} = \frac{\left(1 - \frac{x_Y}{y_Y}\right) - \left(\frac{y}{y_G} - \frac{y}{y_Y}\right)\times\frac{\left(\frac{x}{y} - \frac{x_Y}{y_Y}\right) - \frac{\left(\frac{x_B}{y_B} - \frac{x_Y}{y_Y}\right)\times\left(1 - \frac{y}{y_Y}\right)}{\frac{y}{y_B} - \frac{y}{y_Y}}}{\frac{x_G}{y_G} - \frac{x_Y}{y_Y} - \frac{\left(\frac{1}{y_G} - \frac{1}{y_Y}\right)\times\left(\frac{x_B}{y_B} - \frac{x_Y}{y_Y}\right)}{\frac{1}{y_B} - \frac{1}{y_Y}}}}{\frac{y}{y_B} - \frac{y}{y_Y}} \times K \times L_A$$

$$L_{Y'} = K \times (L_A - L_{G'} - L_{B'})$$

$$L_{R'} = 0$$

where $L_{G'}$ denotes the green luminance output value in the RGBY luminance output values, $L_{B'}$ denotes the blue luminance output value in the RGBY luminance output values, $L_{R'}$ denotes the red luminance output value in the RGBY luminance output values, $L_{Y'}$ denotes the yellow luminance output value in the RGBY luminance output values, $L_A$ denotes the luminance value of the corresponding point, K denotes the predetermined luminance adjustment coefficient, (x, y) denotes the color coordinate values of the corresponding point in the chromatic diagram, $(x_R, y_R)$ denotes the color coordinate values of the red color in the chromatic diagram, $(x_{,B}, y_B)$ denotes the color coordinate values of the blue color in the chromatic diagram, and $(x_{,y}, y_y)$ denotes the color coordinate values of the yellow color in the chromatic diagram.

2. The method according to claim 1, wherein the determining, according to the color coordinate values of the corresponding point, a position relationship between the corresponding point and a region formed by RBY as well as a position relationship between the corresponding point and a region formed by GBY in the chromatic diagram comprises:

determining whether the color coordinate values of the corresponding point are located in the region formed by RBY in the chromatic diagram;

if yes, determining that the corresponding point is located in the region formed by RBY; and otherwise, determining that the corresponding point is located in the region formed by GBY.

3. The method according to claim 1, wherein the determining color coordinate values and luminance values of the corresponding point of the RGB luminance input values in the chromatic diagram comprises:

calculating the color coordinate values and the luminance values of the corresponding point of the RGB luminance input values in the chromatic diagram by using the following formulas:

$$L_A = L_R + L_G + L_B$$

$$x = \frac{x_R \times \frac{L_R}{y_R} + x_G \times \frac{L_G}{y_G} + x_B \times \frac{L_B}{y_B}}{\frac{L_R}{y_R} + \frac{L_G}{y_G} + \frac{L_B}{y_B}}$$

$$y = \frac{L_R + L_G + L_B}{\frac{L_R}{y_R} + \frac{L_G}{y_G} + \frac{L_B}{y_B}};$$

where $L_A$ denotes the luminance value of the corresponding point, $L_G$ denotes the green luminance input value in the RGB luminance input values, $L_B$ denotes the blue luminance input value in the RGB luminance input values, $L_R$ denotes the red luminance input value in the RGB luminance input values, (x, y) denotes the color coordinate values of the corresponding point in the chromatic diagram, $(x_R, y_R)$ denotes the color coordinate values of the red color in the chromatic diagram, $(x_G, y_G)$ denotes the color coordinate values of the green color in the chromatic diagram, and $(x_{,B}, y_B)$ denotes the color coordinate values of the blue color in the chromatic diagram.

4. The method according to claim 1, wherein the converting received RGB input signals into corresponding RGB luminance input values respectively comprises:

converting the received RGB input signals into the corresponding RGB luminance input values respectively by using the following formulas:

$$L_R = L_{Rmax} \times \left(\frac{Ri}{255}\right)^{\gamma};$$

$$L_G = L_{Gmax} \times \left(\frac{Gi}{255}\right)^{\gamma};$$

$$L_B = L_{Bmax} \times \left(\frac{Bi}{255}\right)^{\gamma};$$

where $L_R$ denotes the red luminance input value in the RGB luminance input values, $L_G$ denotes the green luminance input value in the RGB luminance input values, $L_B$ denotes the blue luminance input value in the RGB luminance input values, Ri denotes the value of the red input signal in the RGB input signals, Gi denotes the value of the green input signal in the RGB input signals, Bi denotes the value of the blue input signal in the RGB input signals, $L_{Rmax}$ denotes the maximum red luminance value, $L_{Gmax}$ denotes the maximum green luminance value, $L_{Bmax}$ denotes the maximum blue luminance value, and y denotes the Gamma conversion factor.

5. The method according to claim 1, wherein the converting the determined RGBY luminance output values into corresponding RGBY output signals respectively and outputting the corresponding RGBY output signals comprises:

converting the determined RGBY luminance output values into the corresponding RGBY output signals respectively by using the following formulas:

$$R_0 = \left(\frac{L_{R'}}{L_{Rmax}}\right)^{\frac{1}{\gamma}} \times 255;$$

$$G_0 = \left(\frac{L_{G'}}{L_{Gmax}}\right)^{\frac{1}{\gamma}} \times 255;$$

$$B_0 = \left(\frac{L_{B'}}{L_{Bmax}}\right)^{\frac{1}{\gamma}} \times 255;$$

$$Y_0 = \left(\frac{L_{Y'}}{L_{Ymax}}\right)^{\frac{1}{\gamma}} \times 255;$$

where $L_{R'}$ denotes the red luminance output value in the RGBY luminance output values, $L_{G'}$ denotes the green luminance output value in the RGBY luminance output values, $L_{B'}$ denotes the blue luminance output value in the RGBY luminance output values, $L_{Y'}$ denotes the yellow luminance output value in the RGBY luminance output values, $R_0$ denotes the value of the red output signal in the RGBY output signals, $G_0$ denotes the value of the green output signal in the RGBY output signals, $B_0$ denotes the value of the blue output signal in the RGBY output signals, $Y_0$ denotes the value of the yellow output signal in the RGBY output signals, $L_{Rmax}$ denotes the maximum red luminance value, $L_{Gmax}$ denotes the maximum green luminance value, $L_{Bmax}$ denotes the maximum blue luminance value, $L_{ymax}$ denotes the maximum yellow luminance value, and y denotes the gamma conversion factor.

6. A system for converting an image from RGB input signals to RGBY output signals, comprising:

a processor that is configured to execute instructions stored in a non-transitory storage medium, wherein the instructions include:

receiving the RGB input signals;

converting the received RGB input signals into corresponding RGB luminance input values respectively;

determining color coordinate values and luminance values of a corresponding point of a corresponding RGB luminance input values in a chromatic diagram, determine, according to the color coordinate values of the corresponding point, a position relationship between the corresponding point and a region formed by RBY as well as a position relationship between the corresponding point and a region formed by GBY in the chromatic diagram, and determine RGBY luminance output values according to the determined position relationships, a predetermined luminance adjustment coefficient, the color coordinate values and the luminance values of the corresponding point respectively; and converting the determined RGBY luminance output values into corresponding RGBY output signals respectively; and outputting the corresponding RGBY output signals, wherein when the processor determines that the corresponding point is located in the region formed by RBY, calculate the RGBY luminance output values by using the following formulas:

$$L_{R'} = \frac{\left(\frac{x}{y} - \frac{x_Y}{y_Y}\right) - \frac{\left(\frac{x_B}{y_B} - \frac{x_Y}{y_Y}\right) \times \left(1 - \frac{y}{y_Y}\right)}{\frac{y}{y_B} - \frac{y}{y_Y}}}{\frac{x_R}{y_R} - \frac{x_Y}{y_Y} - \frac{\left(\frac{1}{y_R} - \frac{1}{y_Y}\right) \times \left(\frac{x_B}{y_B} - \frac{x_Y}{y_Y}\right)}{\frac{1}{y_B} - \frac{1}{y_Y}}} \times K \times L_A$$

$$L_{B'} = \frac{\left(1 - \frac{y}{y_Y}\right) - \left(\frac{y}{y_R} - \frac{y}{y_Y}\right) \times \frac{\left(\frac{x}{y} - \frac{x_Y}{y_Y}\right) - \frac{\left(\frac{x_B}{y_B} - \frac{x_Y}{y_Y}\right) \times \left(1 - \frac{y}{y_Y}\right)}{\frac{y}{y_B} - \frac{y}{y_Y}}}{\frac{x_R}{y_R} - \frac{x_Y}{y_Y} - \frac{\left(\frac{1}{y_R} - \frac{1}{y_Y}\right) \times \left(\frac{x_B}{y_B} - \frac{x_Y}{y_Y}\right)}{\frac{1}{y_B} - \frac{1}{y_Y}}}}{\frac{y}{y_B} - \frac{y}{y_Y}} \times K \times L_A$$

$$L_{Y'} = K \times (L_A - L_{R'} - L_{B'})$$

$$L_{G'} = 0,$$

or when the processor determines that the corresponding point is located in the region formed by GBY, calculate the RGBY luminance output values by using the following formulas:

$$L_{G'} = \frac{\left(\frac{x}{y} - \frac{x_Y}{y_Y}\right) - \frac{\left(\frac{x_B}{y_B} - \frac{x_Y}{y_Y}\right)\times\left(1 - \frac{y}{y_Y}\right)}{\frac{y}{y_B} - \frac{y}{y_Y}}}{\frac{x_G}{y_G} - \frac{x_Y}{y_Y} - \frac{\left(\frac{1}{y_G} - \frac{1}{y_Y}\right)\times\left(\frac{x_B}{y_B} - \frac{x_Y}{y_Y}\right)}{\frac{1}{y_B} - \frac{1}{y_Y}}} \times K \times L_A$$

$$L_{B'} = \frac{\left(1 - \frac{y}{y_Y}\right) - \left(\frac{y}{y_G} - \frac{y}{y_Y}\right)\times\frac{\left(\frac{x}{y} - \frac{x_Y}{y_Y}\right) - \frac{\left(\frac{x_B}{y_B} - \frac{x_Y}{y_Y}\right)\times\left(1 - \frac{y}{y_Y}\right)}{\frac{y}{y_B} - \frac{y}{y_Y}}}{\frac{x_G}{y_G} - \frac{x_Y}{y_Y} - \frac{\left(\frac{1}{y_G} - \frac{1}{y_Y}\right)\times\left(\frac{x_B}{y_B} - \frac{x_Y}{y_Y}\right)}{\frac{1}{y_B} - \frac{1}{y_Y}}}}{\frac{y}{y_B} - \frac{y}{y_Y}} \times K \times L_A$$

$$L_{Y'} = K \times (L_A - L_{G'} - L_{B'})$$

$$L_{R'} = 0$$

where $L_{G'}$ denotes the green luminance output value in the RGBY luminance output values, $L_{B'}$ denotes the blue luminance output value in the RGBY luminance output values, $L_{R'}$ denotes the red luminance output value in the RGBY luminance output values, $L_{y'}$ denotes the yellow luminance output value in the RGBY luminance output values, $L_A$denotes the luminance value of the corresponding point, K denotes the predetermined luminance adjustment coefficient, (x, y) denotes the color coordinate values of the corresponding point in the chromatic diagram, $(x_R, y_R)$ denotes the color coordinate values of the red color in the chromatic diagram, $(x_B, y_B)$ denotes the color coordinate values of the blue color in the chromatic diagram, and $(x_y, y_y)$ denotes the color coordinate values of the yellow color in the chromatic diagram.

7. The system according to claim 6, wherein the instructions include: determining whether the color coordinate values of the corresponding point are located in the region formed by RBY in the chromatic diagram; if yes, determining that the corresponding point is located in the region formed by RBY; and otherwise, determining that the corresponding point is located in the region formed by GBY.

8. The system according to claim 6, wherein the instructions include calculating the color coordinate values and the luminance values of the corresponding point of the RGB luminance input values in the chromatic diagram by using the following formulas:

$$L_A = L_R + L_G + L_B$$

$$x = \frac{x_R \times \frac{L_R}{y_R} + x_G \times \frac{L_G}{y_G} + x_B \times \frac{L_B}{y_B}}{\frac{L_R}{y_R} + \frac{L_G}{y_G} + \frac{L_B}{y_B}}$$

-continued $$y = \frac{L_R + L_G + L_B}{\frac{L_R}{y_R} + \frac{L_G}{y_G} + \frac{L_B}{y_B}};$$

where $L_A$ denotes the luminance value of the corresponding point, $L_G$ denotes the green luminance input value in the RGB luminance input values, $L_B$ denotes the blue luminance input value in the RGB luminance input values, $L_R$ denotes the red luminance input value in the RGB luminance input values, (x, y) denotes the color coordinate values of the corresponding point in the chromatic diagram, $(x_R, y_R)$ denotes the color coordinate values of the red color in the chromatic diagram, $(x_G, y_G)$ denotes the color coordinate values of the green color in the chromatic diagram, and $(x_B, y_B)$ denotes the color coordinate values of the blue color in the chromatic diagram.

9. The system according to claim 6, wherein the instructions include converting the received RGB input signals into the corresponding RGB luminance input values respectively by using the following formulas:

$$L_R = L_{Rmax} \times \left(\frac{Ri}{255}\right)^{\gamma};$$

$$L_G = L_{Gmax} \times \left(\frac{Gi}{255}\right)^{\gamma};$$

$$L_B = L_{Bmax} \times \left(\frac{Bi}{255}\right)^{\gamma};$$

where $L_R$ denotes the red luminance input value in the RGB luminance input values, $L_G$ denotes the green luminance input value in the RGB luminance input values, $L_B$ denotes the blue luminance input value in the RGB luminance input values, Ri denotes the value of the red input signal in the RGB input signals, Gi denotes the value of the green input signal in the RGB input signals, Bi denotes the value of the blue input signal in the RGB input signals, $L_{Rmax}$ denotes the maximum red luminance value, $L_{Gmax}$ denotes the maximum green luminance value, $L_{Bmax}$ denotes the maximum blue luminance value, and y denotes the Gamma conversion factor; and wherein the reverse-converting unit is specifically configured to convert the determined RGBY luminance output values into the corresponding RGBY output signals respectively by using the following formulas:

$$R_0 = \left(\frac{L_{R'}}{L_{Rmax}}\right)^{\frac{1}{\gamma}} \times 255;$$

$$G_0 = \left(\frac{L_{G'}}{L_{Gmax}}\right)^{\frac{1}{\gamma}} \times 255;$$

$$B_0 = \left(\frac{L_{B'}}{L_{Bmax}}\right)^{\frac{1}{\gamma}} \times 255;$$

$$Y_0 = \left(\frac{L_{Y'}}{L_{Ymax}}\right)^{\frac{1}{\gamma}} \times 255;$$

where $L_{R'}$ denotes the red luminance output value in the RGBY luminance output values, $L_{G'}$ denotes the green luminance output value in the RGBY luminance output values, $L_{B'}$ denotes the blue luminance output value in the RGBY luminance output values, $L_{Y'}$ denotes the yellow luminance output value in the RGBY luminance output values, $R_0$ denotes the value of the red output signal in the RGBY output signals, $G_0$ denotes the value of the green output signal in the RGBY output signals, $B_0$ denotes the value of the blue output signal in the RGBY output signals, $Y_0$ denotes the value of the yellow output signal in the RGBY output signals, $L_{Rmax}$ denotes the maximum red luminance value, $L_{Gmax}$ denotes the maximum green luminance value, $L_{Bmax}$ denotes the maximum blue luminance value, $L_{ymax}$ denotes the maximum yellow luminance value, and y denotes the gamma conversion factor.

10. A non-transitory storage medium, in which computer programs are stored, the computer programs including instructions that are executable by a processor to achieve:

receiving RGB input signals;

converting received RGB input signals into corresponding RGB luminance input values respectively;

determining color coordinate values and luminance values of the corresponding point of the corresponding RGB luminance input values in a chromatic diagram;

determining, according to the color coordinate values of the corresponding point, a position relationship between the corresponding point and a region formed by RBY as well as a position relationship between the corresponding point and a region formed by GBY in the chromatic diagram;

determining RGBY luminance output values according to the determined position relationships, a predetermined luminance adjustment coefficient, the color coordinate values and the luminance values of the corresponding point respectively; and converting the determined RGBY luminance output values into corresponding RGBY output signals respectively and outputting the corresponding RGBY output signals, wherein the determining the RGBY luminance output values according to the determined position relationships, a predetermined luminance adjustment coefficient, the color coordinate values and the luminance values of the corresponding point respectively comprises:

when it is determined that the corresponding point is located in the region formed by RBY, calculating the RGBY luminance output values by using the following formulas:

$$L_{R'} = \frac{\left(\frac{x}{y} - \frac{x_Y}{y_Y}\right) - \frac{\left(\frac{x_B}{y_B} - \frac{x_Y}{y_Y}\right)\times\left(1 - \frac{y}{y_Y}\right)}{\frac{y}{y_B} - \frac{y}{y_Y}}}{\frac{x_B}{y_R} - \frac{x_Y}{y_Y} - \frac{\left(\frac{1}{y_R} - \frac{1}{y_Y}\right)\times\left(\frac{x_B}{y_B} - \frac{x_Y}{y_Y}\right)}{\frac{1}{y_B} - \frac{1}{y_Y}}} \times K \times L_A$$

-continued $$L_{B'} = \frac{\left(1 - \frac{y}{y_Y}\right) - \left(\frac{y}{y_R} - \frac{y}{y_Y}\right)\times\frac{\left(\frac{x}{y} - \frac{x_Y}{y_Y}\right) - \frac{\left(\frac{x_B}{y_B} - \frac{x_Y}{y_Y}\right)\times\left(1 - \frac{y}{y_Y}\right)}{\frac{y}{y_B} - \frac{y}{y_Y}}}{\frac{x_R}{y_R} - \frac{x_Y}{y_Y} - \frac{\left(\frac{1}{y_R} - \frac{1}{y_Y}\right)\times\left(\frac{x_B}{y_B} - \frac{x_Y}{y_Y}\right)}{\frac{1}{y_B} - \frac{1}{y_Y}}}}{\frac{y}{y_B} - \frac{y}{y_Y}} \times K \times L_A$$

$$L_{Y'} = K \times (L_A - L_{R'} - L_{B'})$$

$$L_{G'} = 0$$

or when it is determined that the corresponding point is located in the region formed by GBY, calculate the RGBY luminance output values by using the following formulas:

$$L_{G'} = \frac{\left(\frac{x}{y} - \frac{x_Y}{y_Y}\right) - \frac{\left(\frac{x_B}{y_B} - \frac{x_Y}{y_Y}\right)\times\left(1 - \frac{y}{y_Y}\right)}{\frac{y}{y_B} - \frac{y}{y_Y}}}{\frac{x_G}{y_G} - \frac{x_Y}{y_Y} - \frac{\left(\frac{1}{y_G} - \frac{1}{y_Y}\right)\times\left(\frac{x_B}{y_B} - \frac{x_Y}{y_Y}\right)}{\frac{1}{y_B} - \frac{1}{y_Y}}} \times K \times L_A$$

$$L_{B'} = \frac{\left(1 - \frac{y}{y_Y}\right) - \left(\frac{y}{y_G} - \frac{y}{y_Y}\right)\times\frac{\left(\frac{x}{y} - \frac{x_Y}{y_Y}\right) - \frac{\left(\frac{x_B}{y_B} - \frac{x_Y}{y_Y}\right)\times\left(1 - \frac{y}{y_Y}\right)}{\frac{y}{y_B} - \frac{y}{y_Y}}}{\frac{x_G}{y_G} - \frac{x_Y}{y_Y} - \frac{\left(\frac{1}{y_G} - \frac{1}{y_Y}\right)\times\left(\frac{x_B}{y_B} - \frac{x_Y}{y_Y}\right)}{\frac{1}{y_B} - \frac{1}{y_Y}}}}{\frac{y}{y_B} - \frac{y}{y_Y}} \times K \times L_A$$

$$L_{Y'} = K \times (L_A - L_{G'} - L_{B'})$$

$$L_{R'} = 0$$

where $L_{G'}$ denotes the green luminance output value in the RGBY luminance output values, $L_{B'}$ denotes the blue luminance output value in the RGBY luminance output values, $L_{R'}$ denotes the red luminance output value in the RGBY luminance output values, $L_{Y'}$ denotes the yellow luminance output value in the RGBY luminance output values, $L_A$ denotes the luminance value of the corresponding point, K denotes the predetermined luminance adjustment coefficient, (x, y) denotes the color coordinate values of the corresponding point in the chromatic diagram, $(x_R, y_R)$ denotes the color coordinate values of the red color in the chromatic diagram, $(x_B, y_B)$ denotes the color coordinate values of the blue color in the chromatic diagram, and $(x_y, y_y)$ denotes the color coordinate values of the yellow color in the chromatic diagram.

* * * * *